United States Patent [19]

Chikaoka et al.

[11] Patent Number: 4,750,914

[45] Date of Patent: Jun. 14, 1988

[54] METHOD OF MANUFACTURING CAST-IRON BONDED DIAMOND WHEEL

[75] Inventors: Yasuji Chikaoka, Aichi; Kenichi Watanabe, Nagoya, both of Japan

[73] Assignee: Brother Kogyo Kabushiki Kaisha, Aichi, Japan

[21] Appl. No.: 62,087

[22] Filed: Jun. 15, 1987

[30] Foreign Application Priority Data

Jun. 24, 1986 [JP] Japan ..... 61-147294

[51] Int. Cl.[4] ..... B24D 3/06

[52] U.S. Cl. ..... 51/293; 51/309

[58] Field of Search ..... 51/293, 309

[56] References Cited

U.S. PATENT DOCUMENTS 4,523,930 6/1985 Williston ..... 51/293
4,591,363 5/1986 Silverman ..... 51/293
4,634,453 1/1987 Hay et al. ..... 51/293
4,671,021 6/1987 Takahashi et al. ..... 51/293

*Primary Examiner*—A. Lionel Clingman
*Assistant Examiner*—Willie J. Thompson
*Attorney, Agent, or Firm*—Parkhurst & Oliff

[57] ABSTRACT

A method of manufacturing a cast-iron bonded diamond wheel, by using a cast iron as a bond for holding diamond particles together. After a powder mixture consisting of the diamond particles and the cast iron is molded into a desired formed body, a core tube of a heating furnace is loaded with the formed body. The core tube is maintained in a fluid-tight condition, and a flow of pure $H_2$ gas is introduced into the core tube, so as to maintain the atmosphere within the core tube such that a dew point of the atmosphere is −50° C. or lower. In this condition, the core tube is heated from the outside, whereby the formed mass of diamond abrasive and cast iron bond is sintered into the diamond wheel.

10 Claims, 2 Drawing Sheets

METHOD OF MANUFACTURING CAST-IRON BONDED DIAMOND WHEEL

BACKGROUND OF THE INVENTION

1. Field of the Invention

The present invention relates in general to a method of producing a grinding wheel by using diamond particles as an abrasive material, and a cast iron as a bonding agent for holding the diamond particles together in the form of a desired shape. More particularly, the invention is concerned with an effective method of manufacturing a cast-iron bonded diamond wheel, which requires a simple sintering step that does not cause deterioration of the diamond particles due to oxidation.

2. Discussusion of the Prior Art

For bonding diamond particles for a diamond grinding wheel, there are known several types of bond, for example, metal bonds, resinoid bonds, vitrified bonds, and electrodeposited bonds, which are selected depending upon the required properties of the diamond wheels for specific grinding operations. In particular, metal bonds are generaly suited to diamond wheels for grinding hard and brittle material such as ceramics, stones, glass and concrete. Among these metal bonds for the diamond wheels is available a cast iron bond.

A cast-iron bonded diamond wheel is manufactured by preparing a powder mixture of suitable diamond particles and cast iron particles, molding the prepared powder mixture into a desired shape, and sintering or firing the obtained formed body. The sintering of the formed mass of the cast iron bond and the diamond abrasive must be effected for complete sintering of the cast iron particles, without deterioration of the diamond particles. However, the optimum range of sintering temperature of the cast iron bond is comparatively narrow, i.e., between 1125° C. and 1150° C., while the diamond is oxidized in air into carbon dioxide, with its weight being reduced, at 600° C. or higher. Therefore, the sintering temperature and atmosphere are key factors that affect the quality of the cast-iron bonded diamond wheels.

To avoid such deterioration of the diamond particles due to oxidation, the heating to sinter the formed mass of the cast iron and diamond particles has been conventionally practiced within a heating furnace which contains a non-oxidizing atmosphere such as hydrogen or cracked ammonia gas. In the case where either of these furnaces is new or used after a long period of non-use, the diamond particles are subject to deterioration due to the presence of a certain amount of adsorbed gases on the wall surfaces of the furnace, which results in undesirable quality of the sintered diamond wheel. In other words, the sintering process using such heating furnaces requires a long pre-production or monitoring run, before the quality of the sintered products reaches a satisfactory level.

Further, the sintering operation using a heating furnace containing hydrogn or cracked ammonia gas requires a complicated procedure for loading the furnace with unsintered formed bodies of cast iron and diamond, by use of a sintering boat. Described more specifically, a layer of alumina powder is first formed over the surface of the sintering boat, and then the unsintered formed bodies are placed on the alumina layer. Finally, the formed bodies on the boat are covered with a thin layer of cast iron powder. These complicated procedure is necessary in order to minimize undesirable effects of oxygen and other gases within the heating furnace, when the formed bodies of cast iron and diamond are sintered therein.

SUMMARY OF THE INVENTION

It is accordingly an object of the present invention to provide a method of manufacturing a cast-iron bonded diamond grinding wheel, which requires a simple sintering step that assures freedom of the diamond particles from deterioration due to oxidation.

The above object can be attained according to the principle of the present invention, which provides a method of manufacturing cast-iron bonded diamond grinding wheel, by using a cast iron as a bond for holding particles of diamond together in a desired shape, the method comprising: molding a powder mixture of the diamond and the cast iron, into a formed body corresponding the desired shape of the grinding wheel; loading a core tube of a heating furnace with the formed body of the powder mixture, and maintaining the core tube in a fluid tight condition; introducing a flow of pure $H_2$ gas into the core tube, to maintain an atmosphere in the core tube such that a dew point of the atmosphere is −50° C. or less; and heating the core tube from the outside, and thereby sintering the formed body of the powder mixture.

In the method of the present invention as described above, pure $H_2$ gas is introduced into the fluid-tight core tube of the heating furnace such as a tubular furnace, so that the dew point of the atmosphere in the core tube is −50° C. or lower. In this condition, the sintering of the formed "green" body of the powder mixture of cast iron and diamond is effected by heating the core tube within the furnace. This arrangement neither causes deterioration of the diamond grains, nor requires the covering of the formed body with an alumina layer. Thus, the present method requires a simple sintering step that permits desirable quality of the sintered product.

The formed green body of a powder mixture of the cast-iron bond and the diamond abrasive, which is sintered according to the present invention, is prepared by mixing suitable proportions of diamond and cast iron particles, and press-molding the obtained mix to a configuration corresponding to the desired shape of the diamond wheel to be produced. The grain sizes of the diamond as an abrasive material and the cast iron as a bonding agent, and their proportions, may be suitably determined depending upon the specific applications of the grinding wheel to be manufactured. Although the diamond particles and the cast iron particles are essential elements of the powder mixture for forming the unsintered formed body, it is possible to add suitable metal powders such as pure iron particles, and other agents or aids, in appropriate proportions.

BRIEF DESCRIPTION OF THE DRAWINGS

The thus prepared unsintered body for a diamond grinding wheel is then loaded into the core tube of the heating furnace, and is sintered into the desired cast-iron bonded diamond wheel, according to the principle of the present invention which will be described in detail, referring to the accompanying drawings, in which.

DETAILED DESCRIPTION OF THE INVENTION

An example of the heating furnace arrangement equipped with a core tube as described above is illustrated in FIGS. 1 and 2.

Figure 2:
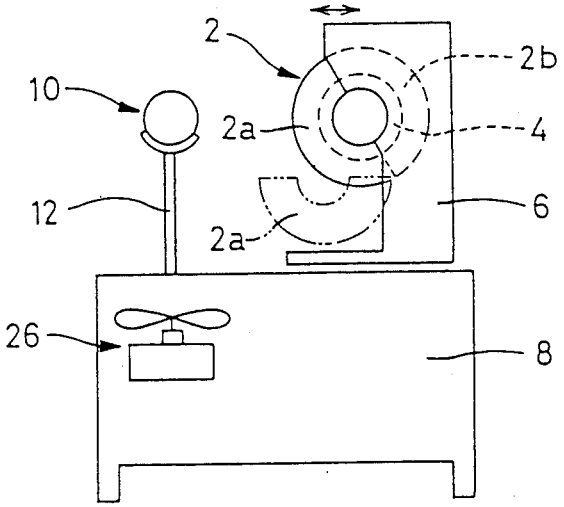
FIG. 2 is a schematic side elevational view of the heating furnace arrangement of FIG. 1.

In these figures, reference numeral 2 designates a cyindrical furnace body in which a heater 4 is incorporated, such that the heater 4 is disposed along the inner surface of the cylindrical furnace body 2. As shown in FIG. 2, the furnace body 2 consists of a pair of semi-cylindrical halves, i.e., a lower half 2*a* and an upper half 2*b*. The lower and upper halves 2*a*, 2*b* are coupled to each other at their corresponding circumferential ends, for example, by suitable hinges, so that the furnace body 2 may take an operative or sintering position and an inoperative or load/unload position. In the operative position, the two halves 2*a*, 2*b* form a cylindrical shape as indicated in solid line in FIG. 2. The lower half 2*a* of the furnace body 2 in the operative position may be pivotally turned downward, to place the furnace body in its inoperative position in which the lower half 2*a* takes the horizontal position as indicated in two-dot chain line in FIG. 2. The furnace body 2 is secured, at its upper half 2*b*, to a movable support device 6 which is movably mounted on a base 8. The support device 6 is movable on the base 8, in the directions indicated by arrows in FIG. 2. The base 8 incorporates control devices, temperature regulating and recording devices, and other devices.

Figure 1:
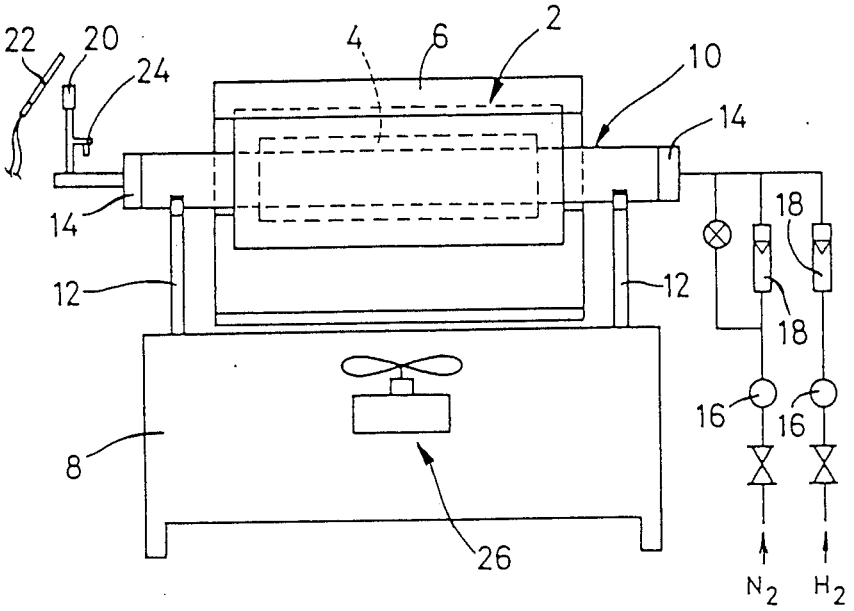
FIG. 1 is a schematic front elevation of a heating furnace arrangement suitably used to practice the present invention.

The core tube of the heating furnace 2 is indicated at 10. This tube 10 is made of a heat resisting steel such as Inconel (Ni-Cr-Fe alloy), a ceramic material or other suitable materials. The base 8 is provided with a pair of upright supports 12, 12 which have a predetermined height from the top of the base. The upright supports 12, 12 are spaced apart from each other in the direction perpendicular to the direction of movement of the movable support device 6. These upright supports 12, 12 are provided to support the core tube 10, so that the core tube 10 may be set in the furnace body 2 positioned near the upright supports 12, 12 by the movable support device 6. Described more specifically, the core tube 10 is set such that the tube 10 extends through the center bore defined by the lower and upper halves 2*a*, 2*b*, as shown in FIG. 1. When the core tube 10 is set in the furnace body 2, the movable support device 6 is positioned near the upright supports 12, 12, and the furnace body 2 is placed in its inoperative load/unload position, in which the lower half 2*a* is open relative to the fixed upper half 2*b*. Then, the core tube 10 is transferred from the upright supports 12, 12 to the furnace body 2, and the lower half 2*a* is brought to its closed position, whereby the furnace body 2 is placed in its operative or sintering position. In this condition, the heater 4 incorporated in the furnace body 2 is energized to heat the core tube 10 from the outside toward the inside, and to thereby sinter the formed green body for the diamond wheel.

The core tube 10 is adapted to be fluid-tightly closed at its opposite ends by respective closure plugs 14, 14. A conduit is connected to the core tube 10 through one of these two plugs 14, for introducing a flow of nitrogen ($N_2$) gas or pure hydrogen gas ($H_2$) into the core tube 10. Further, another conduit is connected to the core tube 10 through the other plug 14, for discharging the atmosphere from the core tube 10. The $N_2$ or $H_2$ gas delivered from a suitable source is supplied to the core tube 10 via a pressure reducing valve 16, 16 and a flow control meter 18, 18, so that the pressure and flow rate of the gas are suitably regulated. The exhaust gases produced within the core tube 10 during a sintering operation are discharged through the above-indicated conduit, and are burned by an exhaust gas burner 20 in the ambient atmosphere.

Reference numeral 22 in FIG. 1 designates an igniter disposed near the burner 20, for igniting the exhaust gases, and reference numeral 24 indicates a sampling tap provided between the closure plug 14 and the burner 20, for samping the exhaust gases. Further, reference numeral 26 designates a cooling fan supported by the base 8. The cooling fan 26 is provided for positive rapid cooling of the core tube 10 while being supported on the upright supports 14, 14, after the core tube 10 is released from the furnace body 2 (by moving the movable support device 6 away from the upright supports 14, 14).

The formed green or unsintered bodies of a powder mixture of cast iron and diamond are sintered by the thus constructed heating arrangement in the following procedure:

Initially, the core tube 10 is loaded with the formed green bodies, while the core tube 10 is supported on the upright supports 14, 14, with the furnace body 2 positioned away from the upright supports 14, 14, as indicated in FIG. 2. For facilitating the loading, it is advisable to use a suitable sintering boat. In this case, the formed bodies are accommodated in the intering boat, and this boat is inserted into the core tube 10. After the opposite open ends of the loaded core tube 10 are closed by the closure plugs 14, 14, the core tube 10 is purged of the existing air, by introducing a flow of $N_2$ gas through one of the closed ends, i.e., the inlet end (right-hand side end, as viewed in FIG. 1). Then, the core tube 10 is set in the furnace body 2 which has been pre-heated. This setting is accomplished by moving the movable support device 6 to the left (as viewed in FIG. 2), so that the furnace body 2 in its inoperative load/unload position receives the core tube 10 supported by the upright supports 14, 14.

Upon completion of the setting of the core tube 10 in the furnace body 2, the flow of the $N_2$ gas through the core tube 10 is terminated, and the $N_2$ gas remaining in the core tube 10 is replaced by a flow of pure $H_2$ gas introduced through the inlet end of the tube 10. The heater 4 is controlled to elevate the sintering temperature within the core tube 10, up to a level between 1125° C. and 1150° C., while the exhaust gases produced within the core tube 10 are burned by the exhaust-gas burner 20, with the igniter 22 activated. The sintering temperature within the specified range is maintained. At the same time, the dew point of the atmosphere within the core tube 10 is held at −50° C. or lower. For this purpose, the exhaust gases are sampled through the samping tap 24, to check the dew point of the atmosphere within the core tube 10.

Figure 3:
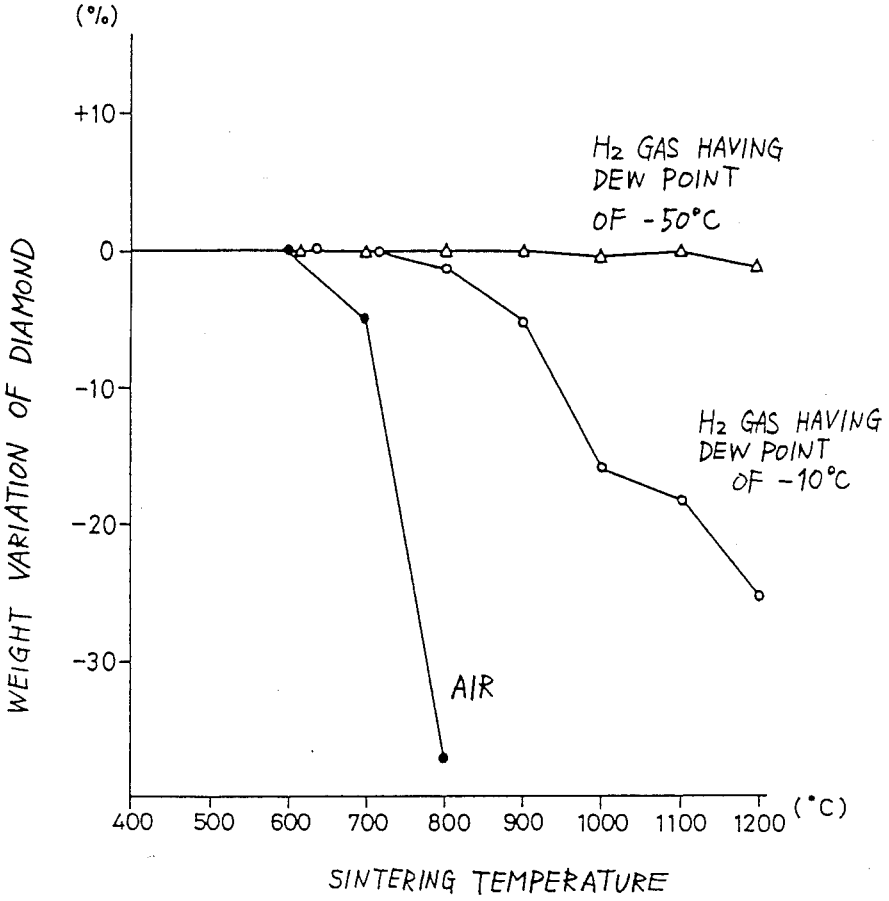
FIG. 3 is a graphical representation of a relation between a sintering temperature and a weight reduction of diamond grains, when sintered in different atmospheres.

Referring to FIG. 3, there is shown a relation between a sintering temperature, and a variation in the weight of the diamond contained in the formed bodies which were sintered according to the principle of the present invention as described above. A reduction in the weight indicates deterioration of the diamond due to oxidation. Sintering tests were conducted under three different conditions: (a) Ambient air was entrapped within the core tube 10, with its opposite ends closed; (b) Pure $H_2$ gas having a dew point of about −10° C. was introduced through the core tube 10; and (c) Pure $H_2$ gas having a dew point of −50° C. was introduced through the core tube 10, according to the principle of the present invention. The experimental results in the three cases (a), (b) and (c) are indicated in the graph of FIG. 3. In the case (a), the oxidation deterioration of the diamond was initiated at a sintering temperature in the neighborhood of 600° C. As shown in the graph, the weight reduction of the diamond amounts to as large as 37%, at a sintering temperature of 800° C. In the case (b) where the atmosphere within the core tube 10 was adjusted so as to have a dew point of about −10° C., a significant degree of the weight reduction of the diamond was recognized. In the case (c) according to the present invention, substantially no oxidation deterioration of the diamond was confirmed. Thus, the experiments reveal that the diamond particles are almost free from oxidation deterioration even at a sintering temperature as high as 1200° C., if the dew point of the atmosphere within the core tube 10 is maintained at −50° C. or lower.

The present invention was developed based on the above finding that the oxidation deterioration of the diamond particles of the sintered body of a cast-iron bonded diamond wheel is effectively minimized, by effecting the sintering of the formed green body within the core tube 10, while controlling the dew point of the sintering atmosphere so as not to exceed −50° C. The above-indicated excellent result according to the present invention was obtained, without the conventionally required provisions for covering the formed green body by an alumina layer.

After the formed body of the cast iron and diamond particles has been sintered for a suitable length of time within the core tube 10 in the manner discussed above, the lower half 2a of the furnace body 2 was opened, and the movable support device 6 was moved to the right (in FIG. 2) to release the core tube 10 from the furnace body 2 placed in its inoperative load/unload position. As a result, the core tube 10 and the sintered formed bodies (cast-iron bonded diamond wheels) were rapidly cooled in air. Preferably, the cooling fan 26 was activated to blow air against the outer surface of the core tube 10, and thereby positively cool the core tube 10 and the sintered diamond wheels therein. This rapid cooling of the sintered diamond wheels by the cooling fan 26 permits normalization of the cast iron structure of the sintered bodies, which causes to produce a pearlite structure. The pearlite structure obtained by this normalization of the cast iron structure significantly contributes to enhancement in the properties of the obtained cast-iron bonded diamond wheels, in particular, increased bonding force or strength of the cast iron for holding together the diamond wheels.

After the temperature of the sintered diamond wheels within the core tube 10 has been lowered by the external cooling of the core tube 10, to a level at which the diamond is not subject to oxidation deterioration, the flow of the pure $H_2$ gas through the core tube 10 is replaced by a flow of the $N_2$ gas. The flow of the $N_2$ gas is also terminated when the temperature of the sintered bodies has been lowered down to the room temperature. Then, the sintered bodies, i.e., cast-iron bonded diamond wheels are taken out of the core tube 10.

EXAMPLES

To further clarify the concept of the present invention, some examples embodying the invention will be given. It is to be understood, however, that the invention is not confined to the precise details of these illustrated examples, and that various changes, modifications and improvements may be made in the invention, without departing from the spirit and scope of the invention.

Cylindrical green bodies of cast iron and diamond grains, prepared as described below, were sintered by means of the heating furnace arrangement (equipped with the cooling fan 26) as shown in FIGS. 1 and 2.

The diamond particles used were sized by passing them through 140–170 mesh screens, and the cast iron particles were sized by passing them through 200–250 mesh screens. The cast iron contains 3.6% by weight of carbon (C). In addition to the diamond and cast iron particles, pure iron particles were used to form the green bodies. An intimate powder mixture for the green bodies was obtained by thoroughly mixing 25% by volume of the diamond particles, 56% by volume of the cast iron particles, and 19% by volume of the pure iron particles. The powder mixture was press-molded under heat in an ordinary manner, to produce the cylindrical green bodies, which have an outside diameter of 10 mm, an inside diameter of 6 mm, and a height of 10 mm.

Subsequently, the prepared green bodies were accommodated in a sintering boat, and the loaded boat was placed within the core tube 10. After the open ends of the core tube 10 were closed by the closure plugs 14, 14, the core tube 10 was purged of the air, by introducing $N_2$ gas. Then, the core tube 10 was set in the furnace body 2 which had been pre-heated to 1000°–1100° C. The $N_2$ gas flow was replaced by a pure $H_2$ gas flow, and the core tube 10 was externally heated by the heater 4, while controlling the the atmosphere within the core tube 10 so that the dew point of the atmosphere is −50° C. or lower. The core tube 10 was heated until the sintering temperature within the core tube 10 reached 1150° C. The green bodies within the core tube 10 were maintained at this sintering temperature for 40 minutes. In this manner, the green bodies were sintered into cylindrical, cast-iron bonded diamond wheels.

Upon completion of the sintering operation, the core tube 10 was exposed to the ambient air by retracting the furnace body 2, and thus air-cooled. When the temperature within the core tube 10 was sufficiently lowered, the flow of the $H_2$ gas through the tube 10 was again changed to a flow of the $N_2$ gas. The flow of the $N_2$ gas was stopped when the temperature was lowered near the room temperature. The obtained products, i.e., cylindrical cast-iron bonded diamond wheels were removed from the cooled core tube 10.

An inspection of the obtained products shows no deterioration of the diamond particles due to oxidization during the sintering. Thus, the instant arrangement according to the invention was proven to provide an improved method of manufacturing cast-iron bonded diamond grinding wheels which have excellent properties.

The same green bodies were sintered according to the method (a) mentioned above, wherein the sintering was effected with the ambient air entrapped within the closed core tube 10, and according to the method (b)

also mentioned above, where $H_2$ was introduced into the core tube 10, but the dew point of the atmosphere within the tube 10 was maintained around −10° C. The products obtained accoording to these sintering methods exhibited considerable oxidation deterioration of the diamond particles. Some of the specimens showed even an almost perfect loss of the diamond particles.

What is claimed is:

1. A method of manufacturing a cast-iron bonded diamond wheel, by using a cast iron as a bond for holding particles of diamond together in a desired shape, comprising the steps of:

molding a powder mixture of said diamond and said cast iron, into a formed body corresponding to said desired shape;

loading a core tube of a heating furnace with said formed body of the powder mixture, and maintaining said core tube in a fluid tight condition;

introducing a flow of pure $H_2$ gas into said core tube, to maintain an atmosphere in said core tube such that a dew point of said atmosphere is −50° C. or lower; and heating said core tube from an outside thereof, and thereby sintering said formed body of the powder mixture.

2. A method according to claim 1, wherein said loading of said core tube with said formed body is effected in an ambient air, said method further comprising replacing the ambient air in said core tube by $N_2$ gas before said flow of pure $H_2$ is introduced into said core tube.

3. A method according to claim 1, wherein said flow of pure $H_2$ gas is introduced from one of opposite end of said core tube, said method further comprising connecting the other end of said core tube to a gas burner for burning exhaust gases which are discharged from said other end of said core tube while said core tube is heated.

4. A method according to claim 3, further comprising providing a sampling tap disposed between said gas burner and said other end of said core tube, for sampling said exhaust gases to check if said dew point of said atmosphere within said core tube is held at −50° C. or lower.

5. A method according to claim 1, wherein said core tube is heated to a temperature between 1125° C. and 1150° C.

6. A method according to claim 1, further comprising removing said core tube from said heating furnace into the ambient air, and thereby cooling said core tube and the sintered formed body therein and normalizing said cast iron into a pearlite structure.

7. A method according to claim 6, further comprising positively cooling said core tube and said sintered formed body, by a cooling device.

8. A method according to claim 6, further comprising replacing said pure $H_2$ gas by $N_2$ gas after said sintered formed body in the cooled core tube has been cooled down to a level at which said diamond particles are not deteriorated.

9. A method according to claim 1, further comprising positioning said core tube within said heating furance such that an outer circumferential surface is surrounded by a heating device.

10. A method according to claim 9, wherein said positioning said core tube within said heating furnace comprises moving said core tube and said heating furnace relative to each other, such that said core tube is accessible to and removable from said heating device, through an opening between an upper half and a lower half of said heating furnace.

* * * * *